US005497182A

United States Patent [19]

Park

[11] Patent Number: 5,497,182

[45] Date of Patent: Mar. 5, 1996

[54] PRINTER HAVING A ROTATING DRUM

[75] Inventor: Moon-bae Park, Suwon, Rep. of Korea

[73] Assignee: Samsung Electronics Co., Ltd., Kyungki-Do, Rep. of Korea

[21] Appl. No.: 309,495

[22] Filed: Sep. 23, 1994

[30] Foreign Application Priority Data

Sep. 28, 1993 [KR] Rep. of Korea ..... 93-20365

[51] Int. Cl.[6] ..... B41J 25/304; B41J 2/325

[52] U.S. Cl. ..... 347/197; 347/176; 347/218

[58] Field of Search ..... 346/76 PH, 134, 346/138; 400/120, 120.16; 271/275, 277; 347/172, 176, 197, 215, 218

[56] References Cited

U.S. PATENT DOCUMENTS

| | | | |
|---|---|---|---|
| 5,124,724 | 6/1992 | Hatakeyama et al. | 347/172 |
| 5,166,705 | 11/1992 | Roh | 346/138 |
| 5,196,869 | 3/1993 | Park | 346/138 |
| 5,353,049 | 10/1994 | Ro et al. | 346/138 |

*Primary Examiner*—Huan H. Tran

*Attorney, Agent, or Firm*—Sughrue, Mion, Zinn, Macpeak & Seas

[57] ABSTRACT

A printer includes a device for placing the leading edge of a paper sheet at an initial printing position, and a lifting device for raising and lowering a printing head so that the printing head compresses the leading edge of the paper sheet, thereby printing without margins on the paper sheet.

7 Claims, 6 Drawing Sheets

PRINTER HAVING A ROTATING DRUM

BACKGROUND OF THE INVENTION

1. Field of the Invention

The present invention relates to a printer and, more particularly, to a printer whose structure is improved so as to print a picture without leaving margins on the top and bottom of a sheet of paper.

2. Description of the Related Art

Generally, a thermal printer comprises a thermal printing head with a heating element, and a film-shaped ribbon coated with ink. The thermal printer has a transfer structure in which, with the ribbon placed between a sheet of paper and the thermal printing head, ink sublimated by the thermal printing head in a predetermined pattern is delivered onto the paper. Particularly, for full-color printing, a color thermal transfer printer performs a printing operation three times for the color-separated image of yellow, magenta and cyan, respectively.

In such a printer using an ink ribbon on which three (or four) sublimated dyes for yellow, magenta and cyan (or including black) are sequentially coated on one sheet, for every revolution of a drum, the beginning of a predetermined color portion must be searched according to a printing signal and coincide with the initial printing position of the paper.

Referring to FIG. 1 schematically illustrating a conventional printer, a drum 2 is rotatably mounted. A paper cassette 6 is provided under the drum 2. A thermal printing head 1 and an ink ribbon 7 are placed above the drum 2. A plurality of guide rollers 3*a*, 3*b* and 3*c* are provided on the circumference of drum 2. When conveyed from the cassette 6 to the drum 2, a sheet of paper 4 is delivered counterclockwise while making contact with the drum 2 by the guide rollers 3*a* and 3*b*. When the leading edge of the paper 4 is compressed by guide roller 3*c* located beyond the summit S' of the drum 2, the drum 2 stops rotating, and the thermal printing head 1 is lowered by a lift so as to press the paper 4 and the ink ribbon 7. In this state, when the drum 2 rotates, a picture is printed on the paper 4.

As shown in FIG. 1, however, the conventional printer does not print pictures within a section S between the leading edge of paper 4 and the initial compressing position of the thermal printing head 1. This creates a leading edge margin in a printed paper, resulting in a poor appearance.

SUMMARY OF THE INVENTION

Therefore, in order to overcome such a problem, it is an object of the present invention to provide a printer which is improved to print from the leading edge of the sheet of paper so as to obtain a printed picture in which the leading edge margin can be zero, and to conform the leading edge of the paper to the beginning of a predetermined color portion of an ink ribbon.

To accomplish the object of the present invention, there is provided a printer having a drum rotated to convey a sheet of paper to be fed, a ribbon coated with dyes, and a printing head for printing an image on the paper sheet while compressing the ribbon, the printer comprising: means for placing the leading edge of the paper sheet at an initial printing position; and lifting means for raising and lowering the printing head so that the printing head compresses the leading edge of the paper sheet.

BRIEF DESCRIPTION OF THE DRAWINGS

The above object and advantages of the present invention will become more apparent by describing in detail a preferred embodiment thereof with reference to the accompanying drawings in which.

DETAILED DESCRIPTION OF THE PREFERRED EMBODIMENTS

Figure 1:
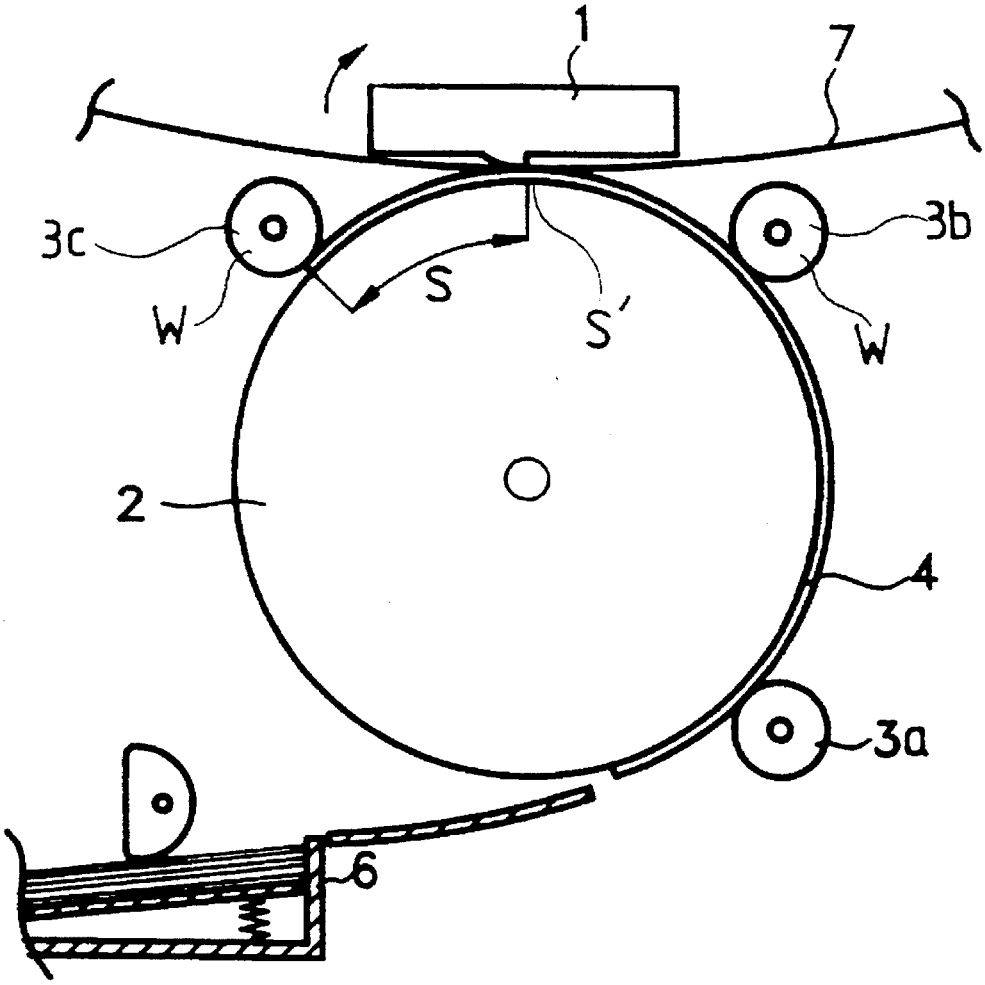
FIG. 1 (PRIOR ART)
FIG. 1 is a schematic view of a conventional printer.
Figure 2:
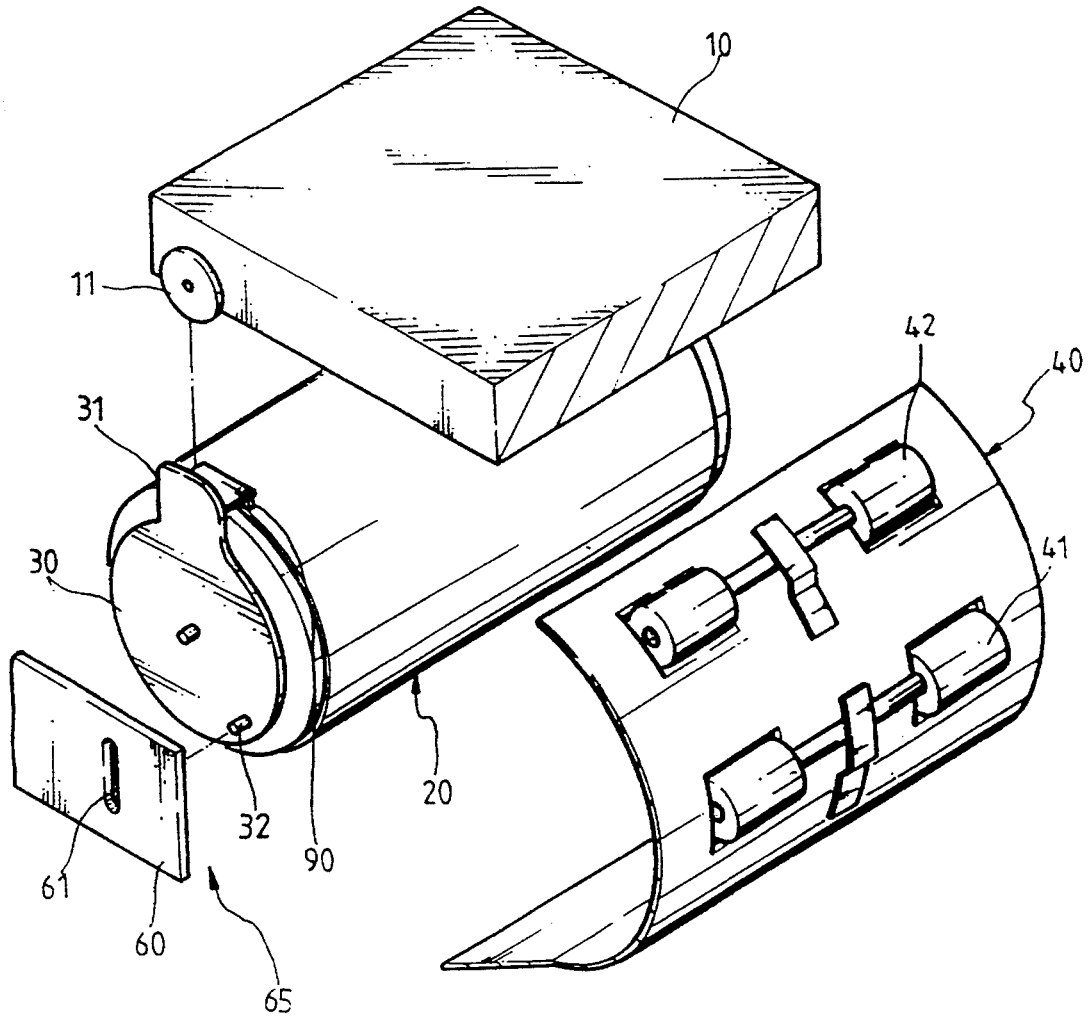
FIG. 2 is an exploded perspective view of a printer of the present invention.

Referring to FIGS. 2, 3, 4 and 5, while supported by a support member 40, a plurality of guide rollers 41 and 42 are provided at the circumference of a drum 20 driven by a motor (not shown). The guide rollers 41 and 42 are made of rubber so that they are in resilient contact with the drum 20. A cassette 50 for feeding paper is placed on one side under the drum 20. A printing head 10 having a heating element is located above the drum 20. An ink ribbon 80, where sublimated ink dyes are sequentially coated on one sheet of paper, is provided between the printing head 10 and the drum 20.

As a feature of the present invention, there is provided a device for placing the leading edge of the paper sheet 70 at an initial printing position, and a lift for raising and lowering the printing head 10 which then presses the leading edge of the paper sheet 70.

The device for placing the leading edge of the paper sheet 70 at the initial printing position, contains a paper sensor 90 for detecting the leading edge of the paper sheet 70 conveyed by the drum 20 at the initial printing position. A signal indicating the leading edge of the paper sheet 70 is sent to the motor (not shown) for driving the drum 20 so as to stop the drum.

The lift comprises cam disks 30 coupled on both sides of the drum 20 on the same axis thereof and each having a cam protrusion 31, and a rotation device 65 for rotating the cam disk 30 by a predetermined angle. Being lowered along the sloped side of cam protrusion 31, printing head 10 compresses the leading edge of the paper sheet 70. Here, a roller 11 is provided on printing head 10 so that roller 11 rolls along cam protrusion 31, to thereby lower the printing head 10.

The rotation device 65 comprises a pin 32 provided on the cam disk 30, a slide 60, having a slot along which pin 32 moves, for sliding left and right by a driving force (not shown). The cam disk 30 rotates by a predetermined angle according to the movement of slide 60.

The cam protrusion 31 is positioned such that its top is situated at the initial printing position. The sensor 90 is located on the internal surface of cam protrusion 31.

The operation of the printer of the present invention constructed as described will be explained hereinbelow.

Figure 3:
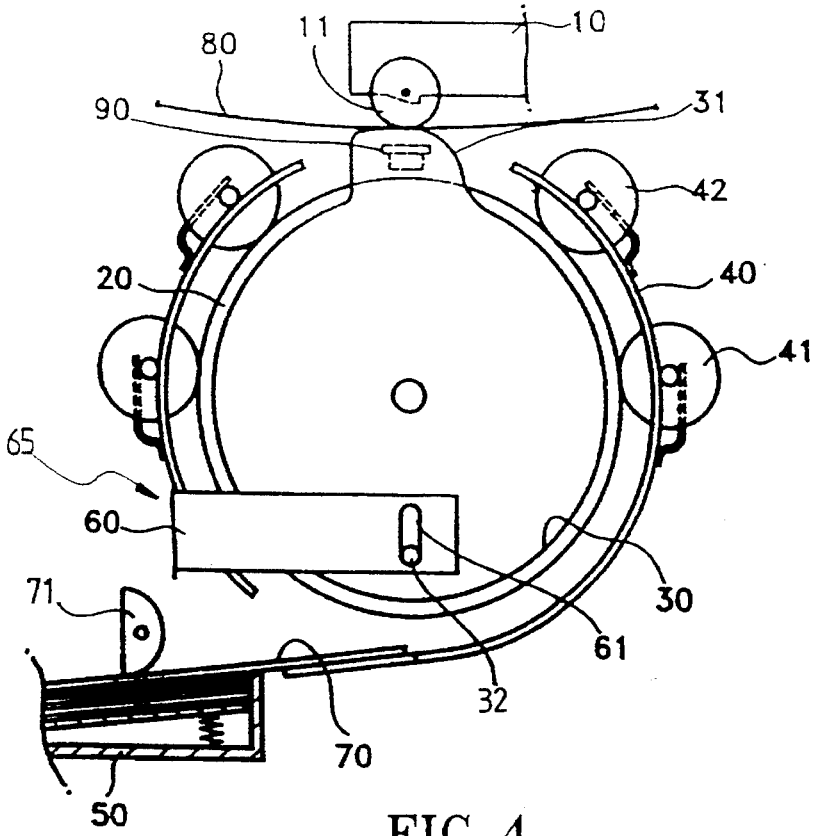
FIGS. 3, 4 and 5 are operational views showing the operation of the printer of the present invention.
Figure 4:
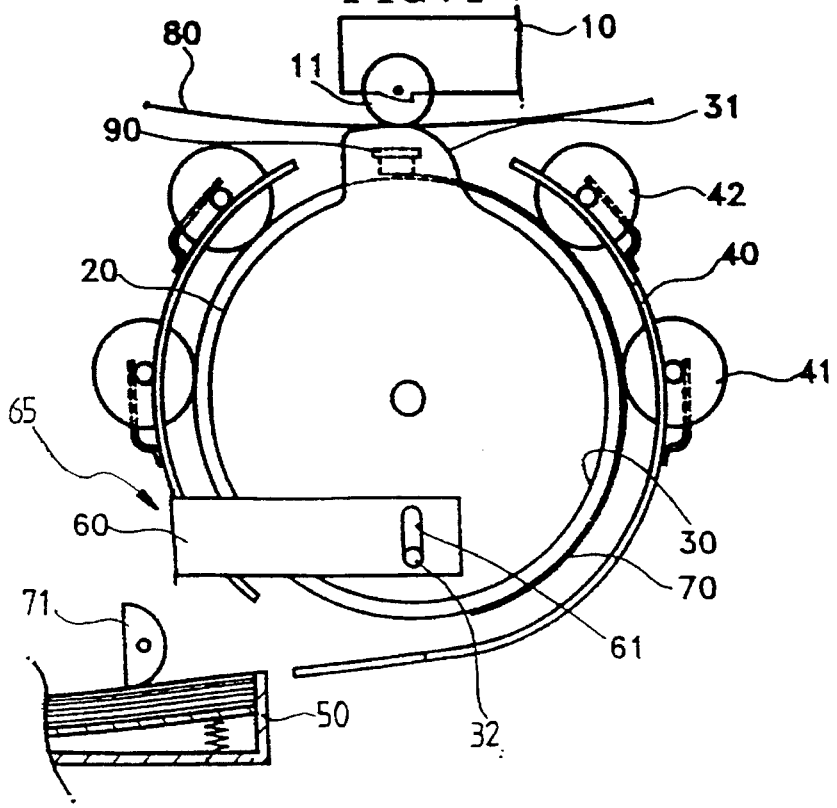
Figure 5:
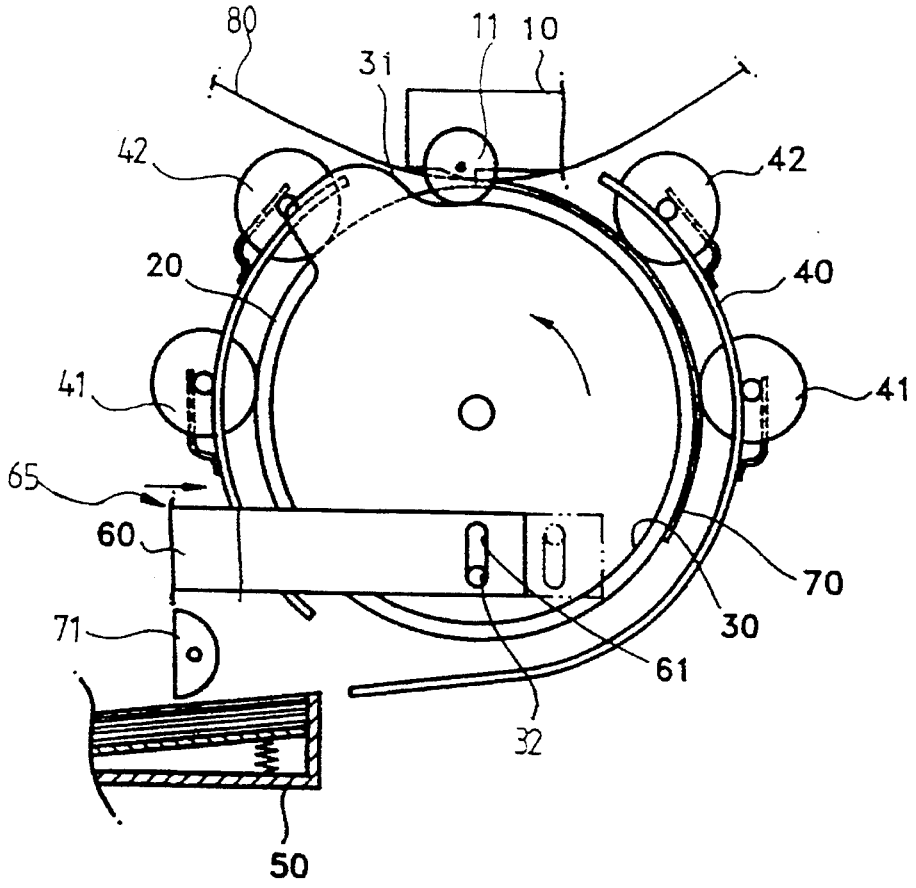
Figure 6:
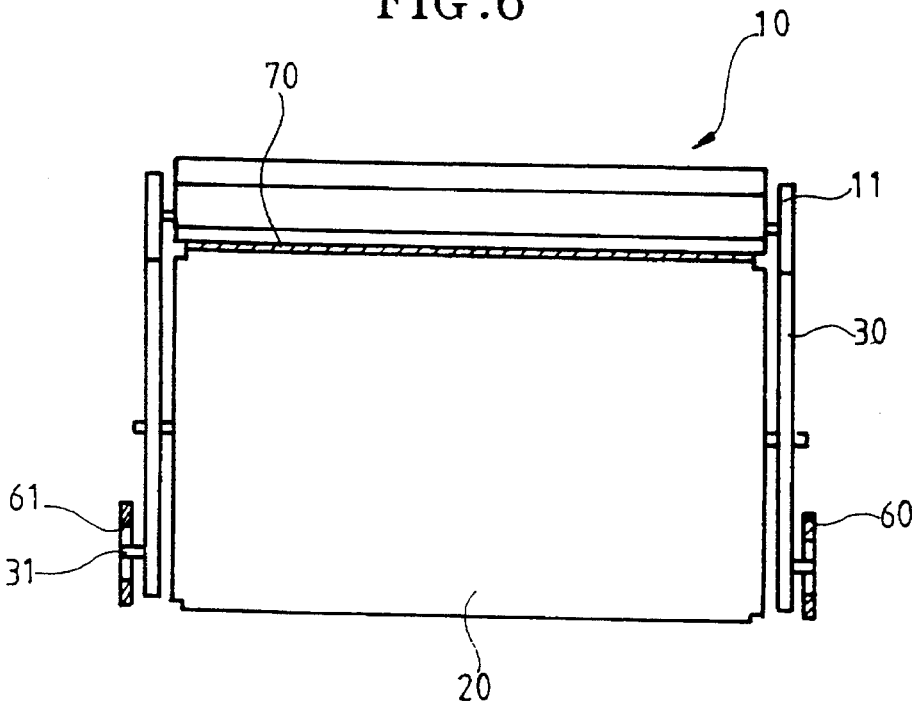
FIG. 6 is a schematic view of the printer of the present invention in a state in which a printing head presses the paper.
Figure 7:
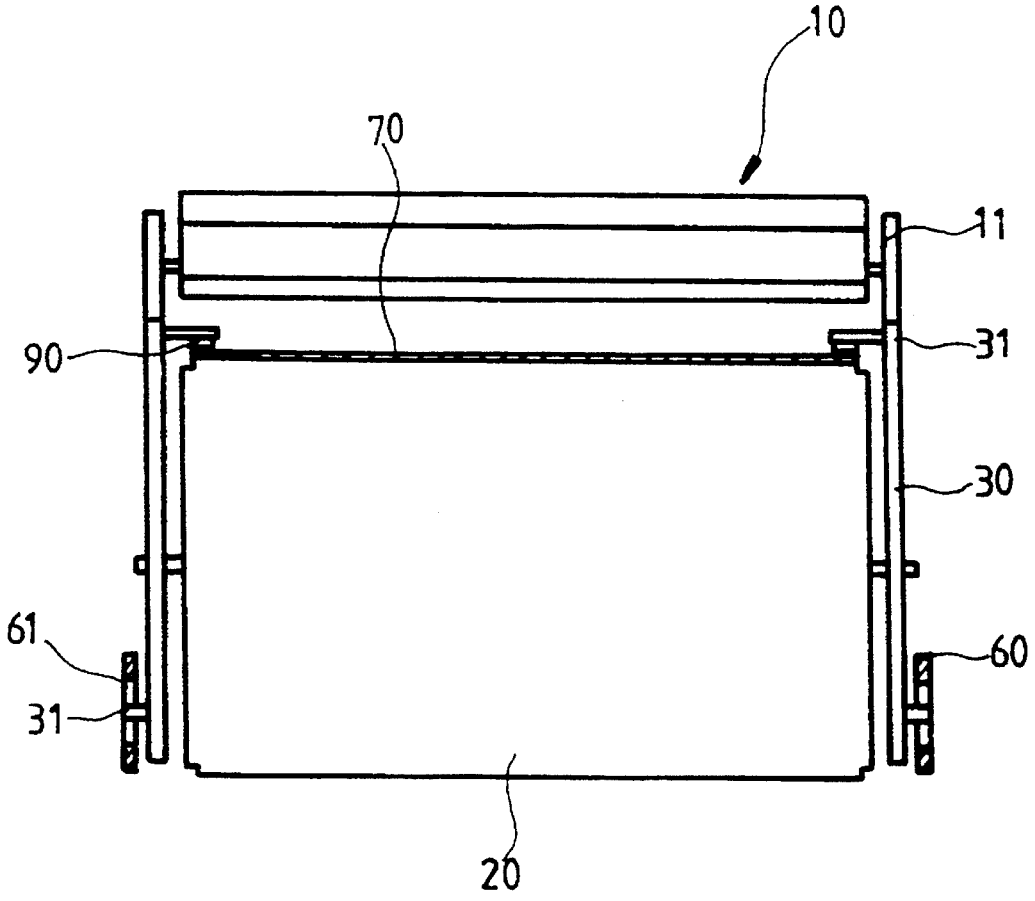
FIG. 7 is a schematic view of the printer of the present invention prior to the printing head's pressing of the paper.

Referring to FIG. 3, being conveyed from cassette 50 to the drum 20 by a paper feeding cam 71 rotated according to a paper feeding signal, the paper sheet 70 is further delivered to a print position while placed between the guide roller 41 and the drum 20. When the leading edge of the paper sheet 70 reaches the initial printing position as shown in FIG. 4, the sensor 90 detects the top end or leading edge of the paper sheet and stops a motor (not shown) for driving the drum 20. Subsequently, the ink ribbon 80 is wound in one direction, and stops when the beginning of a selected color portion coincides with the leading edge of the paper sheet 70. In this state, as slide 60 shifts right as shown in FIG. 5, the cam disk 30 rotates counterclockwise. The roller 11 supported on the top of cam protrusion 31 is lowered by the weight of the printing head 10 along cam protrusion 31, thereby pressing the leading edge of the paper sheet 70. Next, a printing signal rotates the drum 20, and the printing head 10 prints from the leading edge of the paper sheet 70 to the trailing edge thereof, while thermally compressing the ink ribbon 80 and the paper sheet 70. Here, FIG. 6 illustrates a state in which the printing head 10 is compressing the paper sheet 70, with FIG. 7 showing a state in which the printing head 10 is detached from the paper sheet 70.

While the drum 20 rotates one full revolution, the printing head 10 compressively prints a selected color from the leading edge of the paper sheet 70. When the drum 20 rotates another revolution and the leading edge of the paper sheet 70 is detected by the sensor 90, the drum 20 stops. The ink ribbon 80 is wound to stop where the beginning of a different color portion coincides with the leading edge of the paper sheet 70. As explained earlier, in this state, the printing head 10 is lowered to print from the leading edge of the paper sheet 70.

Therefore, printing can be performed from the leading edge of the paper sheet 70, thereby solving a problem in which respective colors are skewed by the operation of the sensor 90 to deteriorate picture quality.

Figure 8:
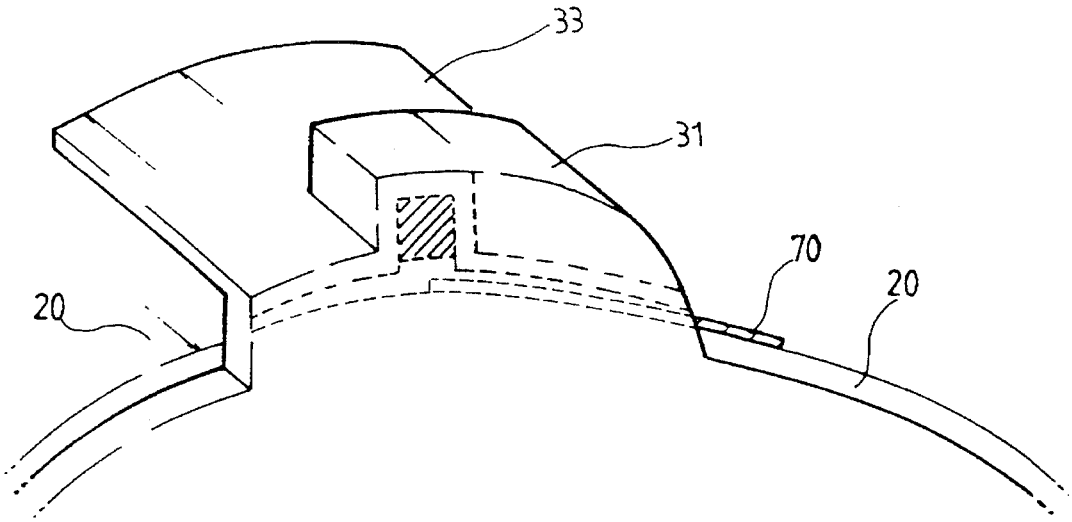
FIGS. 8, 9 and 10 are schematics illustrating states in which the paper is guided around a printing position, in another embodiment of a cam disk having a paper guide portion.
Figure 9:
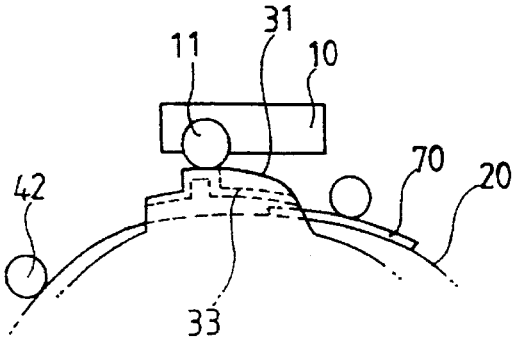
Figure 10:
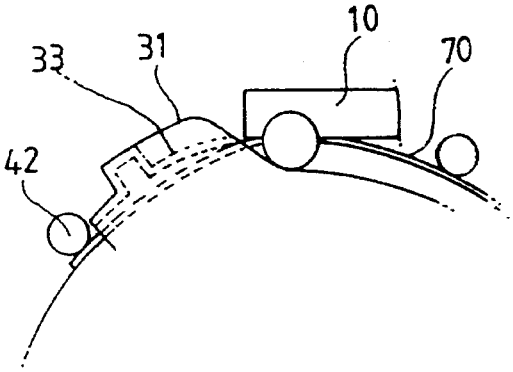

In FIGS. 8, 9 and 10, a paper guide portion 33 is formed on cam protrusion 31 so as to guide the movement of the paper to the printing position. The paper guide portion 33 (FIG. 10) prevents the leading edge of the paper sheet 70 from being passed over the roller 42 during printing.

As described above, the printer of the present invention is advantageous in that printing is performed without margins, from the leading edge of the paper to the trailing edge thereof, and that the leading edge of the paper coincides precisely with the beginning of respective color portions, thus providing enhanced picture quality.

It is contemplated that numerous medications may be made to the printer of the present invention without departing from the spirit and scope of the invention as defined in the following claims.

What is claimed is:

1. A printer having a drum rotated about a drum axis to convey a paper sheet to be fed, a ribbon coated with dyes, and a printing head for printing an image on the paper sheet while compressing the ribbon, said printer comprising:

paper placing means for placing a leading edge of the paper sheet at an initial printing position; and lifting means for raising and lowering said printing head so that said printing head compresses the leading edge of the paper sheet thereby to print from the leading edge of the paper sheet substantially without a leading edge margin.

2. The printer as claimed in claim 1, wherein said paper placing means comprises a paper sensor located at the initial printing position for detecting the leading edge of the paper sheet conveyed by said drum, so that a signal outputted from said paper sensor is transmitted to thereby stop said drum when the leading edge of the paper sheet reaches the initial printing position.

3. The printer as claimed in claim 1, wherein said lifting means comprises a cam disk situated on said drum axis on each end of said drum and having a cam protrusion, and a rotation means for rotating said cam disk for a predetermined angle, so that said printing head is lowered along said cam protrusion and thereby compresses the leading edge of the paper sheet.

4. A printer as claimed in claim 3, wherein said printing head comprises at least one roller in contact with said cam protrusion.

5. The printer as claimed in claim 3, wherein said rotation means comprises a pin formed on said cam disk, and a slide, having a slot along which said pin moves, for sliding left and right, so that said cam disk rotates according to movement of said slide.

6. A printer having a drum rotated about a drum axis to convey a paper sheet to be fed, a ribbon coated with dyes, and a printing head for printing an image on the paper sheet while compressing the ribbon, said printer comprising:

paper placing means for placing a leading edge of the paper sheet at an initial printing position, said paper placing means comprising a paper sensor located at the initial printing position for detecting the leading edge of the paper sheet conveyed by said drum, so that a signal outputted from said paper sensor is transmitted to thereby stop said drum when the leading edge of the paper sheet reaches the initial printing position; and lifting means for raising and lowering said printing head so that said printing head compresses the leading edge of the paper sheet.

7. A printer having a drum rotated about a drum axis to convey a paper sheet to be fed, a ribbon coated with dyes, and a printing head for printing an image on the paper sheet while compressing the ribbon, said printer comprising:

paper placing means for placing a leading edge of the paper sheet at an initial printing position; and lifting means for raising and lowering said printing head so that said printing head compresses the leading edge of the paper sheet, said lifting means comprising a cam disk situated on said drum axis on each end of said drum and having a cam protrusion, and a rotation means for rotating said cam disk for a predetermined angle, so that said printing head is lowered along said cam protrusion and thereby compresses the leading edge of the paper sheet.

* * * * *